United States Patent [19]

Pape

[11] Patent Number: 4,691,823

[45] Date of Patent: Sep. 8, 1987

[54] GOLF BAG INSERT

[76] Inventor: Kenneth R. Pape, 1011 Marlowe Ave., Orlando, Fla. 32809

[21] Appl. No.: 944,576

[22] Filed: Dec. 22, 1986

[51] Int. Cl.[4] ..... A63B 55/00

[52] U.S. Cl. ..... 206/315.6

[58] Field of Search ..... 206/315.2, 315.3, 315.4, 206/315.5, 315.6, 315.7, 315.8

[56] References Cited

U.S. PATENT DOCUMENTS 2,751,955 6/1956 Nahon ..... 206/315.4

4,596,328 6/1986 Solheim ..... 206/315.6

*Primary Examiner*—William Price

*Attorney, Agent, or Firm*—James B. Middleton

[57] ABSTRACT

An insert for a golf bag, for dividing the full depth of the bag, the insert being attachable both to the top and to the bottom of the golf bag. The insert includes one divider along a diameter of the bag, with two additional dividers trisecting the one. All the dividers are fixed to a bottom plate, and the bottom plate can be provided with holes so the bottom plate can be fixed to the bottom of the golf bag. The insert is constructed of polyethylene or other polyolefin so the clubs slide easily into and out of the bag.

6 Claims, 4 Drawing Figures

GOLF BAG INSERT

INFORMATION DISCLOSURE STATEMENT

It is a well recognized problem that golf bags need some form of division so the clubs can be organized for easy retrieval of the desired club. In response to this need, there have been numerous dividers for separating the upper portion of the bag into a plurality of areas. The idea in such construction is to separate the open area of the bag so different clubs can be placed into different areas for some organization. The problem with these dividers is that only the upper portion of the bag is divided. While the organization of clubs exists at the open end of the bag, the shanks and grips of the clubs remain in a jumble at lower end of the bag. This jumble not only renders retrieval somewhat difficult, but also tends to cause damage to the grips on the clubs. The hitting of one grip against another tends to tear up the grips and require replacement, whereas normal wear would not cause such deterioration of the club grips.

The prior art has also recognized the problem of damage to the grips, and the need to separate the clubs to a greater extent. The most commonly used device for protecting the entire shank and grip of a golf club is a tube. A separate tube is utilized for each club, the tube generally being formed of tubular plastic material such as polyethylene or the like. A plurality of such tubes is placed into the golf bag, so one tube receives one golf club. The difficulty with the tubes is that the tubes then become jumbled in the bag in the same manner as did the golf clubs without the tubes. While the individual grips of the clubs are protected, there is still the frustration of pulling out both the club and a tube, and having such a jumble of tubes that the bag is unmanageable.

Another attempt at a solution to the problem is the manufactured bag such as is shown in the U.S. Pat. Burton, No. 2,705,518. The difficulty with the Burton arrangement is that the bag itself is manufactured with a plurality of separate compartments. This would of course increase the cost of the bag in the first place, but it also offers no solution to the problem with the existing bags.

SUMMARY OF THE INVENTION

This invention relates generally to golf bag inserts, and is more particularly concerned with a separate insert that can be placed into an existing bag.

The present invention comprises an insert for dividing the entire depth of the bag for providing a plurality of compartments for organization of clubs. Further, the insert of the present invention is fixed to the bag at both the upper end and the lower end so that, while the dividers themselves are flexible for easy adaptation to a bag, the insert will not become distorted after proper installation within a golf bag.

The device of the present invention is preferably formed of sheet plastic or the like, so fabrication is simple; and, the natural surface of the plastic material allows clubs to slide easily thereover for maximum ease in use. The device of the present invention is quite readily assembled by stitching as with a conventional industrial weight sewing machine, though it will of course be obvious that a device can be assembled by heat sealing, gluing or by other well known attaching means.

BRIEF DESCRIPTION OF THE DRAWINGS

These and other features advantages of the present invention will become apparent from consideration of the following specification when taken in conjunction with the accompanying drawings in which.

DETAILED DESCRIPTION OF THE EMBODIMENT

Figure 1:
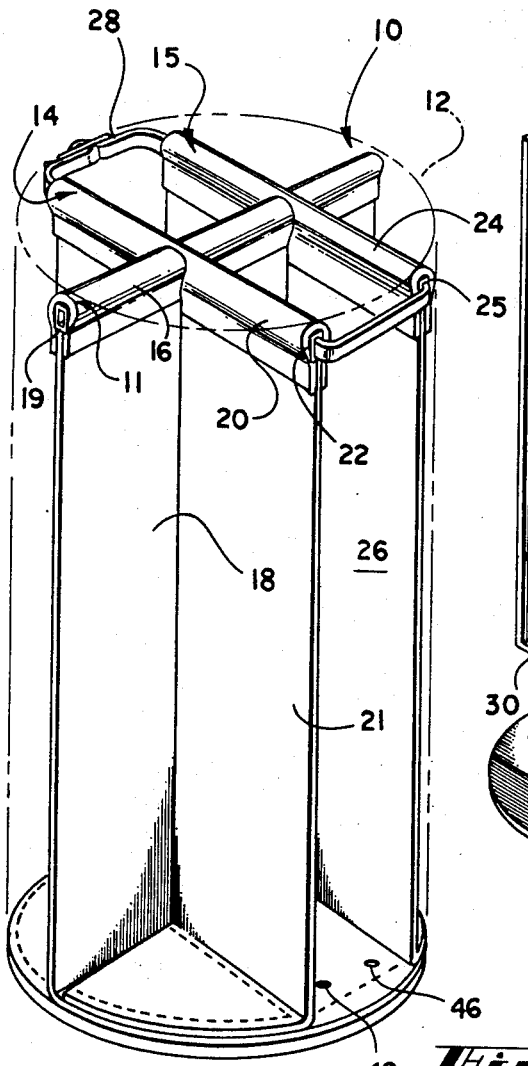
FIG. 1 is perspective view of an insert made in accordance with the present invention, a golf bag being shown in phantom.

Referring now more particularly to the drawings, and that embodiment of the invention here presented by way of illustration, it will be seen that the insert of the present invention is generally designated at 10 and includes a first divider 11 extending generally diametrically of the bag indicated in phantom at 12. Two transverse dividers 14 and 15 substantially trisect the diametrical divider 11.

It will first be seen that the dividers 11, 14 and 15 are made up of sheets of material that form a body of the divider, with a cap piece at the uppermost edge. In one embodiment of the invention, the cap pieces are made of leather so the appearance of the insert is quite attractive in conjunction with the golf bag. Again, it will be readily understood that virtually any flexible material could be used as the cap pieces, depending on the appearance desired.

Looking at the first divider 11, it will be seen that there is a cap piece 16 stitched to the body 18 of the divider 11, and having a rectangular tubular member 19 contained within the cap piece 16. Similarly, the divider 14 includes a cap piece 20 fixed to the body 21 of the divider 14, and tubular member 22 is within the cap piece 20. The divider 15 is similarly constructed with a cap piece 24, tubular member 25 and body of the divider 26.

Figure 3:
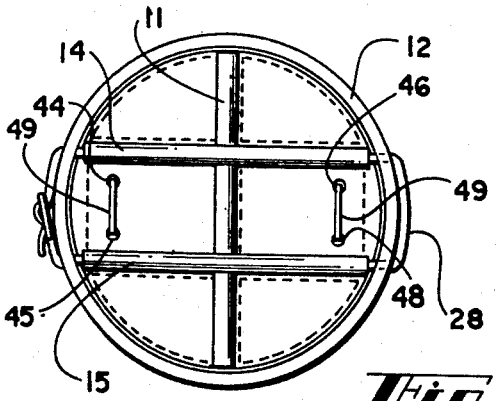
FIG. 3 is a top plan view of a golf bag having the insert shown in FIG. 1 installed therein; and, FIG. 4 is an enlarged fragmentary view showing one means for fixing the bottom of the insert to the golf bag.

Looking at FIG. 3 of the drawings, it will be seen that there is a strap 28 for holding the upper portion of the insert 10 to the golf bag 12. It will be understood that the strap 28 is passed through the tube 22, through the wall of the bag 12 where the strap passes over to the tube 25, then through the tube 25 and out through the opposite wall of the bag. The strap 28 can be provided with a conventional buckle or the like for securing the strap to itself, and the insert 10 to the bag 12.

Figure 2:
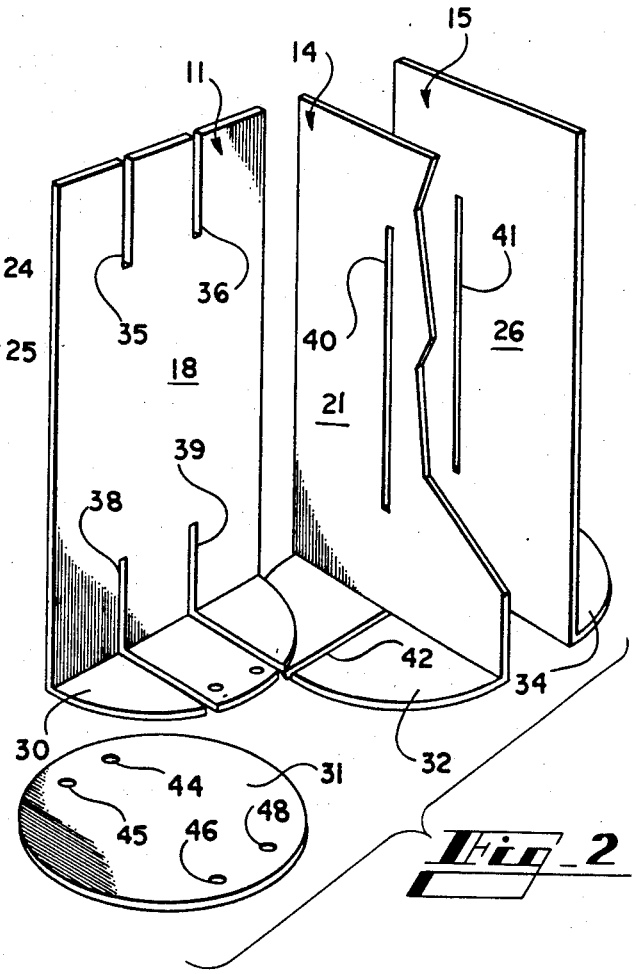
FIG. 2 is an exploded perspective view of the insert shown in FIG. 1.

Attention is next directed to FIG. 2 of the drawings for an understanding of the precise construction of the insert 10. In FIG. 2 it will be seen that the divider member 11 includes the body 18 that is substantially the size to extend the distance of the bag 12, diametrically thereof, and from the bottom to a point adjacent to the top of the bag. The lower end of the body 18 is folded as indicated at 30 to provide a surface for attachment to the bottom plate 31.

The divider 14 is similar to the divider 11, though the width will be somewhat less because the divider 14 is not along the diameter of the bag; however, the divider 14 includes a body 21 with the lower end 32 folded at a generally 90° angle to provide attachment to the bottom plate 31. Finally, the divider 15 is a mirror image of the divider 14, including a body 26 with a folded portion 34.

The divider 11 has a pair of upper notches 35 and 36 and a pair of lower notches 38 and 39 respectively aligned with notches 35 and 36. To cooperate with these notches, it will be seen that the divider 14 includes a central slit 40 while the divider 15 includes a central slit 41. The slits 40 and 41 are reflected in lower notches 42 for dividing the angled portions 32 and 34.

With these notches, it will be understood that the divider 11 will be placed into the slot 40, with the notches 35 and 38 cooperating with the slit 40 to allow an interlocking arrangement. Similarly, the notches 36 and 39 will cooperate with the slit 41 for placement of the divider 15.

With this arrangement, it will be readily seen that the dividers 11, 14 and 15 can be appropriately placed with respect to one another to yield the device shown in FIG. 1 of the drawings. As is indicated in FIGS. 1 and 3 of the drawings, the entire bottom area of the bag insert is stitched, the turned portion 30, 32 and 34 being stitched to the bottom plate 31. Those skilled in the art will readily understand that, at this point, the various layers could easily be heat sealed, or any of numerous adhesives could be utilized to fix the surfaces together.

Figure 4:
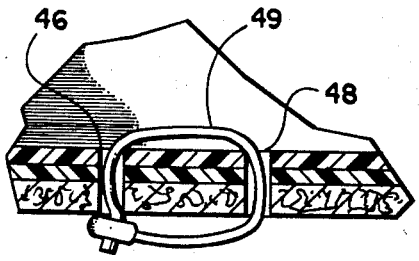

It will be seen that there are two pairs of holes through the bottom portion of the insert 10. FIG. 3 shows the two pairs of holes indicated at 44 and 45 on the left, and 46 and 48 on the right. These holes constitute the means for fixing the lower end of the insert 10 to the bag 12. By simply punching or otherwise providing the holes 44 and 45, and the holes 46 and 48, similar holes can be provided in the bottom of the bag 12 as its shown in FIG. 4 of the drawings. With the holes properly aligned a tying means 49 can be passed through the holes to anchor the bottom of the insert 10 to the bag 12.

While the dividers in the prior art have been formed of numerous materials, it must be realized that some materials are ill-suited to this use. For example there have previously been golf bag dividers made of fabric, in the nature of duck or the like. These dividers tend to be too flimsy for such use, and become severely worn rather quickly, at which point they are more of a detriment than an asset. While leather is generally durable, it will be understood that the leather should have a very high finish to allow ease in sliding the clubs into and out of the bag.

Thus, the preferred material for the insert of the present invention is a sheet plastic, preferably a polyolefin because of the natural, somewhat lubricated, surface of the material. Specifically, a high density polyethylene has been utilized, the high density polyethylene having sufficient natural rigidity for ease in use with the construction shown; yet, the material is flexible so that assembly is possible, and the insert is not extremely rigid in use.

Any thickness of material that has sufficient rigidity and strength to withstand the use shown and discussed will operate satisfactorily. It has been found that the material is available quite readily in a thickness of 27 mils, and this is sufficiently thick to yield a very useable insert. Other material has been found in the vicinity of 32 to 35 mils, and the thicker material seems to be somewhat more desirable.

It will therefore be seen that the device of the present invention provides an insert useable in virtually any existing golf bag. The length of the dividers can be varied for different diameters of bags, and it is contemplated that two or three standard sizes of insert can be manufactured for the two or three standard sizes of bags. While the device could be placed into a bag temporarily and would be of some value, by fixing the upper portion of the insert 10 to the bag itself by means of the strap 28 or the like, and by fixing the bottom of the insert to the bottom of the bag, it will be understood that six invariable chambers are provided for separation of the golf clubs. Each chamber extends completely to the bottom of the bag, and is bounded by the plastic material having a surface on which the club grips will slide easily so the clubs are easy to place into the device and easy to retieve from the device. With the six chambers, there are sufficiently few clubs in each chamber that damage to the grips of the clubs is negligible. Again, it will be obvious that the same construction can be utilized with additional dividers to yield additional compartments.

It will therefore be understood by those skilled in the art that the particular embodiment of the invention here presented is by way of illustration only, and is meant to be in no way restrictive; therefore, numerous changes and modifications may be made, and the full use of equivalents resorted to, without departing from the spirit or scope of the invention as outlined in the appended claims.

I claim:

1. An insert for a golf bag for separating groups of clubs within the golf bag, said insert including a first divider body for extending generally across the golf bag, and a second divider body extending generally perpendicularly to said first divider body, a first cap piece fixed to said first divider body and defining a first opening therethrough, a second cap piece fixed to said second divider body and defining a second opening therethrough, and strap means passing through said second opening for fixing said second cap piece to the upper end of the golf bag, said first divider body having a length to extend to the bottom of the golf bag, and said first divider body further including an angled portion adapted for lying against the bottom surface of the golf bag, said second divider body having a length to extend to the bottom of the golf bag, and said second divider body further including an angled portion adapted for lying against said angled portion of said first divider body, means for fixing said angled portion of said second divider body to said angled portion of said first divider body, and means for fixing said angled portions to the bottom of the golf bag.

2. An insert for a golf bag as claimed in claim 1, said insert further including a bottom plate substantially the size and shape of the bottom of the golf bag, said angled portion of said first divider body being fixed to said bottom plate, said angled portion of said second divider body being fixed to said angled portion of said first divider body and to said bottom plate, said means for fixing said angled portions to the bottom of the golf bag comprising tie means for fixing said bottom plate to the bottom of the golf bag.

3. An insert for a golf bag as claimed in claim 2, said first divider body extending generally along a diameter of the golf bag, said insert further including a third divider body, a third cap piece fixed to said third divider body and defining an opening therethrough, said second divider body and said third divider body substantially trisecting said first divider body, said strap means extending through both said opening through said second cap piece and said opening through said third cap piece.

4. An insert for a golf bag as claimed in claim 3, said third divider body further including an angled portion adapted for lying against said angled portion of said first divider body, means for fixing said angled portion of said third divider body to said angled portion of said first divider body, and means for fixing said angled portions to said bottom plate.

5. An insert for a golf bag as claimed in claim 4, said second divider body defining a slit therein for receiving said first divider body, said first divider body defining notches that are aligned with said slit when said first divider body is received within said slit.

6. An insert for a golf bag as claimed in claim 5, said third divider body defining a slit therein for receiving said first divider body, said first divider body defining second notches that are aligned with said slit in said third divider body when said first divider body is received within said slit within said third divider body.

* * * * *